US006457241B1

(12) United States Patent
Droin

(10) Patent No.: US 6,457,241 B1
(45) Date of Patent: Oct. 1, 2002

(54) ERGONOMIC SCISSORS

(76) Inventor: Michel Droin, Place Benoit Radet, 71570 Romaneche Thorins (FR)

( * ) Notice: Subject to any disclaimer, the term of this patent is extended or adjusted under 35 U.S.C. 154(b) by 0 days.

(21) Appl. No.: 09/785,797

(22) Filed: Feb. 16, 2001

(51) Int. Cl.[7] ..... B26B 13/14

(52) U.S. Cl. ..... 30/232; 30/262; 30/261; 30/254

(58) Field of Search ..... 30/254, 261, 262, 30/296.1, 298, 340, 341, 231, 232; D8/58

(56) References Cited

U.S. PATENT DOCUMENTS

| | | | | | |
|---|---|---|---|---|---|
| 887,494 | A | * | 5/1908 | Mulertz | 30/261 |
| 3,869,793 | A | * | 3/1975 | Ferguson | 30/262 |
| 4,528,707 | A | * | 7/1985 | Aida | 30/254 |
| 5,279,034 | A | | 1/1994 | Smith et al. | |
| 5,463,814 | A | | 11/1995 | Stowell et al. | |
| 6,249,977 | B1 | | 6/2001 | Knoop | |

* cited by examiner

*Primary Examiner*—Hwei-Siu Payer
(74) *Attorney, Agent, or Firm*—Schweitzer Cornman Gross & Bondell LLP

(57) ABSTRACT

In these scissors (1), one of the branches (2) entails a resting part (7) for the four fingers of the hand excluding the thumb, while the other branch (3) entails a resting part (8) for the thumb. The resting part (7) shows an exterior lateral face **(7*a*) to rest the fingers upon and is joined to a hook (10) whose concave face (10*a*) outlines, with said lateral face (7*a*), a housing (11) which can narrowly receive the third or fourth finger of the operator, and whose convex face (10*b*) allows, at the level of the base of hook (10), a tightening of said hook (10) between the finger engaged in the housing (11) and the adjacent finger; the resting part (8) shows an exterior lateral face (8*a*) aimed at accommodating the thumb; the scissors (1) entail at least one elastic device (20) located between the two interal faces of these two resting parts (7&8) allowing the maintenance of the branches (2&3)** in a spread-apart position.

6 Claims, 4 Drawing Sheets

ERGONOMIC SCISSORS

The present invention refers to ergonomic scissors.

BACKGROUND OF THE INVENTION

In most cases, scissors have two rings provided on the sides opposite to the blades, through these rings the user engages the thumb and the third or index finger, to hold and operate the scissors.

Such scissors are however not very easy to use for such persons as children or the handicapped, and scissors whose rings are meant for someone right-handed are not easy to use for someone left-handed and vice-versa.

Furthermore, such standard scissors are not practical when used by hairdressers. In fact, a beautician must remove his or her thumb from the ring in order to grab another tool, then re-engage his or her thumb into the ring to use the scissors again. These movements may have to be repeated many times throughout the day; they are tiring, and at times, painful.

BRIEF DESCRIPTION OF THE INVENTION

The present invention aims to remedy all of these inconveniences.

To that effect, in these scissors, one of the branches includes a rest embossment for the four fingers excluding the thumb, whereas the other branch includes a rest embossment for the thumb. The rest embossment for the four fingers presents an exterior, lateral face to rest these fingers upon, and is joined to a hook, curved in the direction opposite the blade. This lateral, concave face outlines, along with the lateral face of the rest embossment, a housing for the third or the ring finger of the user. The convex face allows, at the location of the base of that hook, a tightening of the hook between the engaged finger and the adjacent finger. The rest embossment for the thumb presents an exterior lateral face aimed to hold the thumb and is widened in a plane perpendicular to the plane of the blades' movement. Furthermore, the scissors include at least one elastic device located between the internal and lateral faces of the rest embossments. This device tends to normally maintain the scissors in a position of mutual separation.

The hook allows a hold of the scissors merely by the positioning of the third or fourth finger in the housing outlined by said hook and by tightening the base of the hook between the engaged and the adjacent fingers. The thumb therefore has no role in the grip of the scissors and is there only to activate the scissors against the reactive force of the elastic device. As a result, the thumb is free in relation to the scissors and can be used to grasp any other tool with the help of the index and third fingers, such as a comb in the case of a beautician, without having to engage or disengage the thumb from the corresponding ring. All fingers but the thumb also allow, jointly with the thumb, through their ample resting surface against said embossment to perfectly direct the scissors while cutting. Furthermore, a left-handed as well as a right-handed person may use the scissors, according to this invention, in the same way, and comfortably.

Preferably, at least one of the rest embossments has, at the location of its extremity closest to the blade, one curved end which is laterally oriented relative to the longitudinal axis of the scissors and towards its exterior, the concave face of this extremity being united in a continuous manner to the aforementioned rest embossment.

This extremity forms a ledge for the side of the index finger for the rest embossment for the four fingers or, for the tip of the thumb for the rest area for the thumb. These ledges allow a firm longitudinal grip of the scissors and good control of the direction when cutting. Said curved extremity and/or the concave face may be shaped in such a way to achieve the best orientation of the thumb when the user grasps the scissors.

Suitably, the rest embossment for the four fingers entails a curved end, such as previously described, and the distance separating said hook and the curved extremity corresponds approximately to the width of the fingers positioned between the hook and this extremity.

The convex face of the hook, the lateral face where the fingers rest and the concave face of said curved extremity outline thereby a space strictly adapted to receive one or more fingers. This increases the reliability of the grip of the scissors and the ease of its manipulation.

The rest embossment for the thumb may present, in the farthest portion relative to the blades, an inflexion towards the exterior of the scissors.

The lateral face of this portion espouses thereby the shape of the thumb and increases, in a longitudinal direction, the pressure surface of the thumb against this rest area. The grip and the control of the scissors are further enhanced.

With the same goal, the rest embossment for the four fingers may present, in its farthest portion relative to the blades, a similar inflexion towards the exterior of the scissors.

Suitably, the scissors entail two helicoidal and conical springs that are both attached to the branches by their smaller extremities. These two springs come into contact through their larger extremities when closing the scissors.

These two springs constitute thereby the elastic device and allow a perfect return to the open position.

BRIEF DESCRIPTION OF THE DRAWINGS

For better comprehension, the invention is again described hereunder with reference to the annexed drawings which illustrate an example of a preferred embodiment of the scissors.

DETAILED DESCRIPTION OF THE INVENTION

Figure 1:
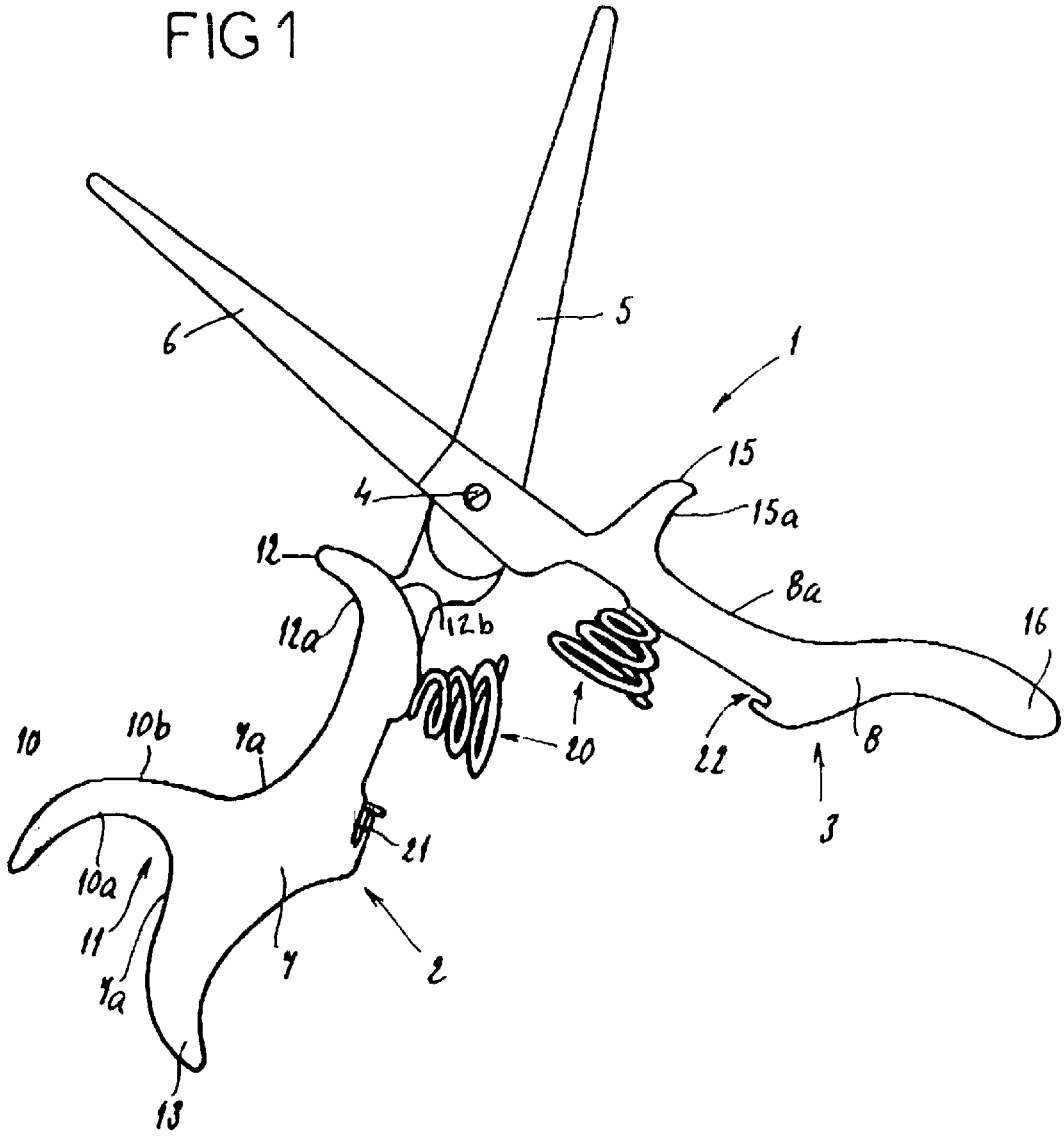
FIG. 1 is an elevation view of the scissors.

These figures represent ergonomic scissors 1 including two branches 2, 3 pivoting relatively to one another around an axis 4.

Each branch 2, 3 includes a blade 5, 6 and a rest embossment 7, 8. These parts 7, 8 allow the grip and use of the scissors 1.

Figure 2:
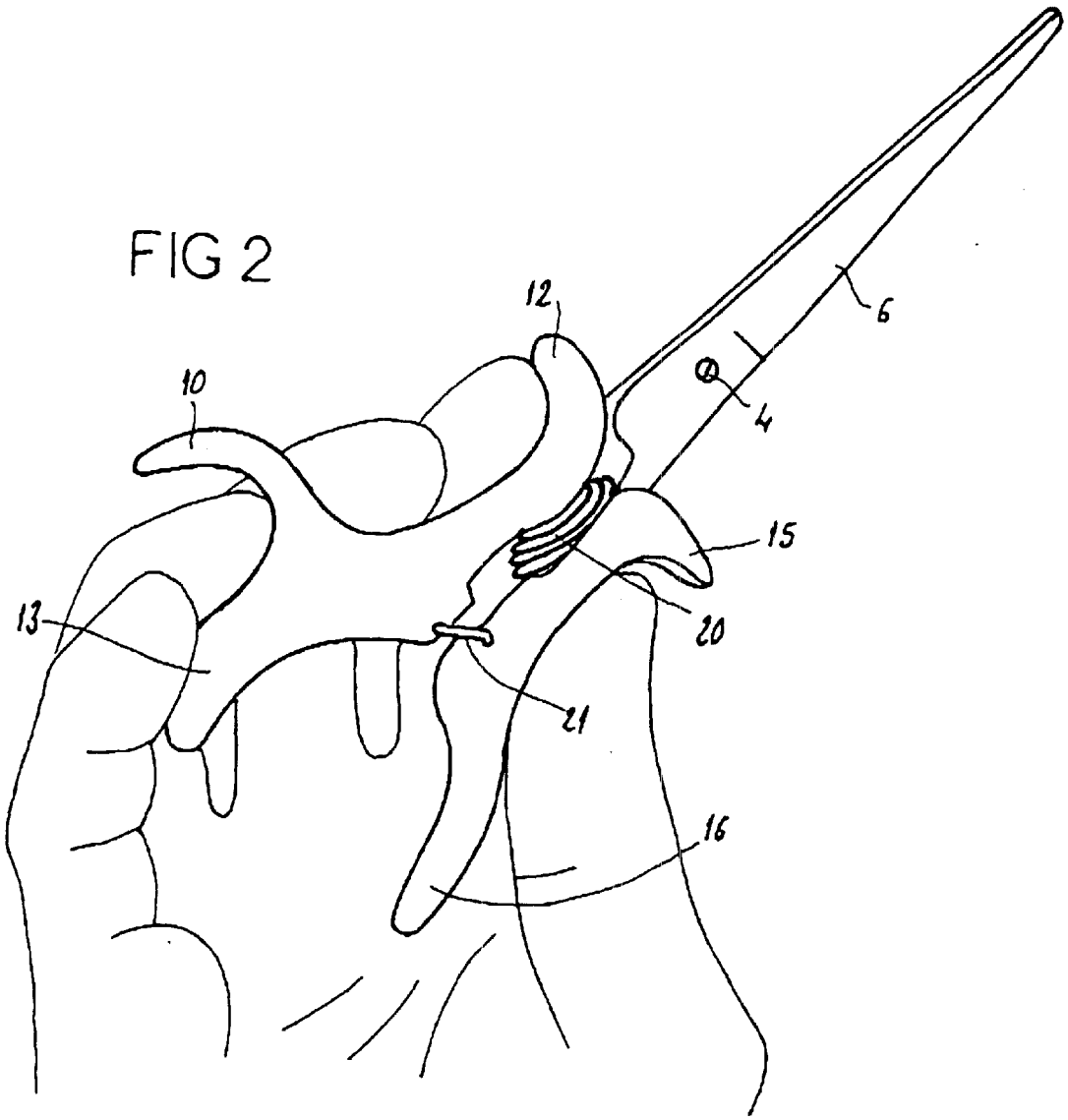
FIG. 2 is a view of the scissors when used by a right-handed person.
Figure 5:
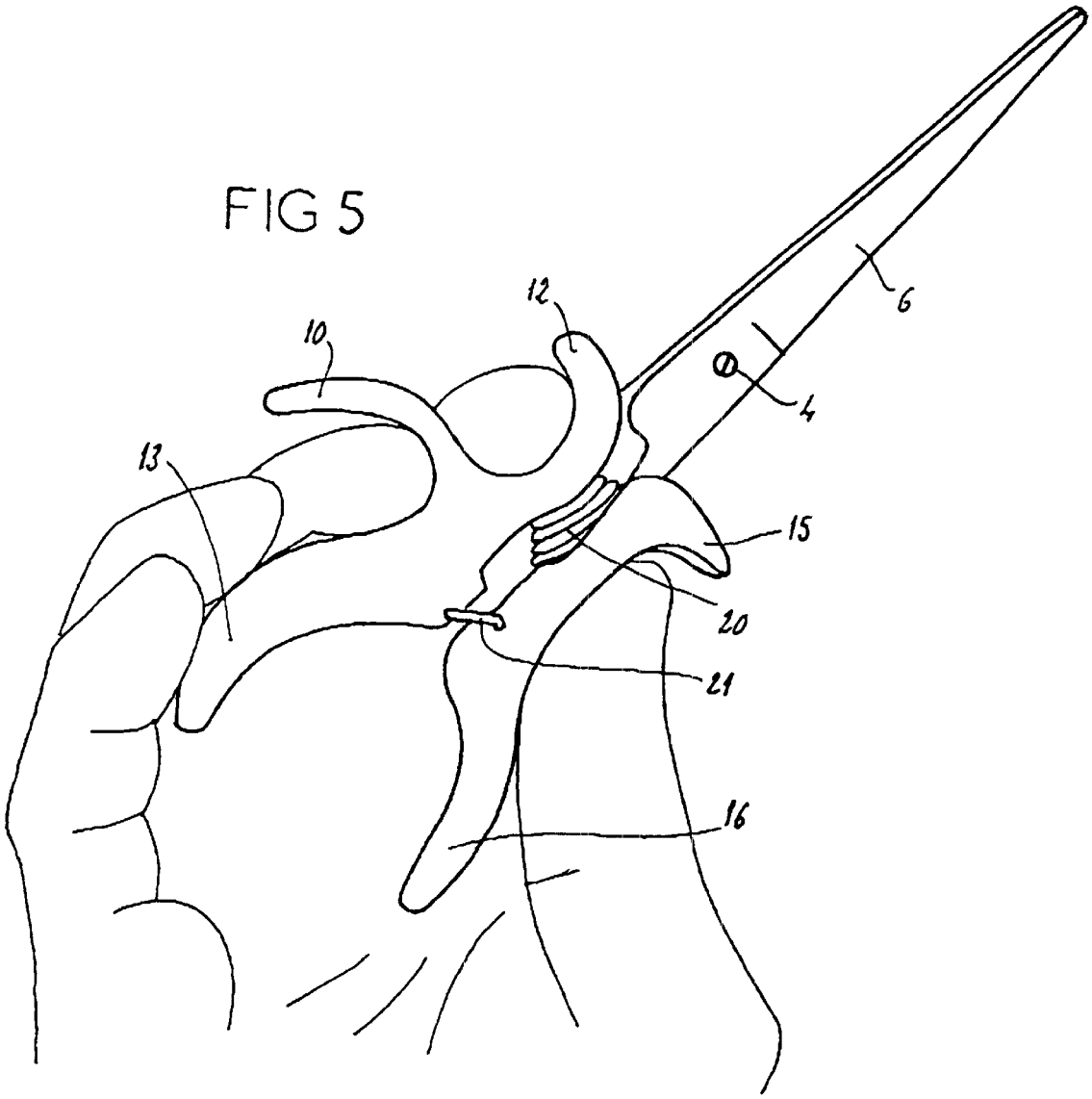
FIG. 5 is similar to FIG. 2, but in a different embodiment.

As shown in FIGS. 2 and 5, the branch 2 includes a rest embossment 7 for the four fingers (thumb excluded) whereas the branch 3 includes a rest embossment 8 for the thumb.

Rest embossment 7 presents an exterior lateral face 7*a* to rest the four fingers which is linked to a hook 10, curved in the direction opposite to the blade 5. The concave lateral face 10*a* of hook 10 outlines with face 7*a* a housing 11 that can receive either the ring finger of the operator in the embodiment of the scissors as shown in FIGS. 1 through 4, or, the third finger of the operator in the version shown in FIG. 5. The convex face 10*b* of the hook 10 allows, at the location of the base of this hook 10, a tightening of the hook between the finger in the housing 11 and the adjacent finger.

Rest embossment 7 also presents, at the location of its extremity close to the blade 5, a curved end 12 laterally oriented relative to the longitudinal axis of scissors branch 2 and towards its exterior. The concave face 12 *a* of this extremity is bent towards face 12 *b* and is contiguous to face 7*a*.

The distance that separates hook 10 from extremity 12 corresponds roughly to the width of the finger (or fingers) meant to rest between the hook 10 and the extremity as shown in FIGS. 2 and 5.

Furthermore, rest embossment 7 has its portion 13 farthest from blade 5 forming an inflexion towards the outside of the scissors 1 in such a way that face 7*a* is shifted towards the exterior at the location of said portion 13.

Rest embossment 8 presents an exterior lateral face 8 *a* aimed to support the thumb; this portion is widened in a plane perpendicular to the plane of the opening of the scissor branches 2, 3 relative to one another.

Figure 3:
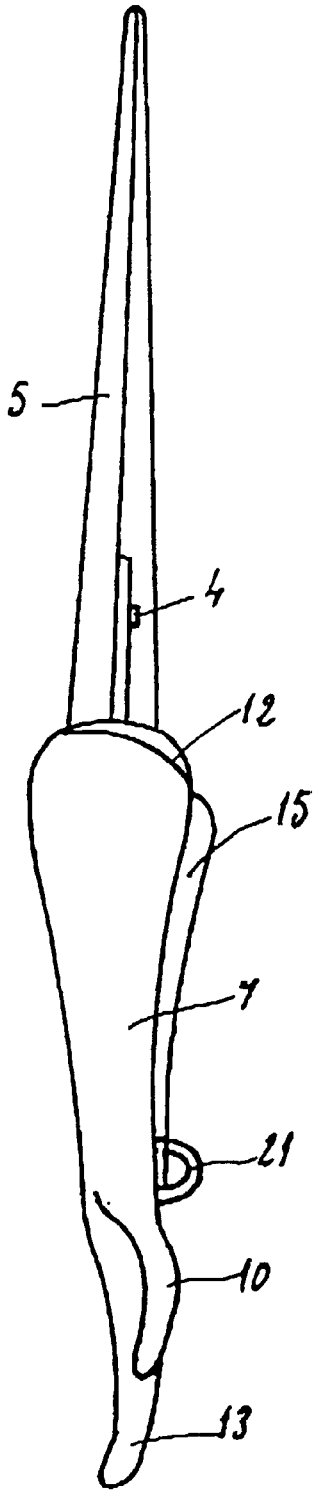
FIG. 3 is a side view of the scissors.

Rest embossment 8 includes an extremity 15 close to the blade 6, which is curved and which is laterally oriented in relation to the longitudinal axis of the branch 3 and its exterior. The concave face 15*a* of this extremity 15 is connected in a contiguous way to face 8*a*. It appears in FIGS. 3 and 4 that extremity 5 is slightly shifted in relation to part 12 in the plane in which the scissors pivot to allow a better grasp. Rest embossment 8 also shows a portion 16 farthest from blade 6 that has an inflected shape towards the exterior in such a way that said portion 16 is suitably formed to wrap around the thumb as shown in FIGS. 2 and 3.

Furthermore, the scissors 1 include two helicoidal springs shaped as cones each of which is attached to part 7 or 8 by its smallest extremity at the location of the internal lateral faces of the parts.

It is shown in these figures that these two springs 20 come to rest upon one another as branches 2 and 3 come together at their greatest extremities and thereby tend to normally maintain branches 2 and 3 in a spread-apart position.

Figure 4:
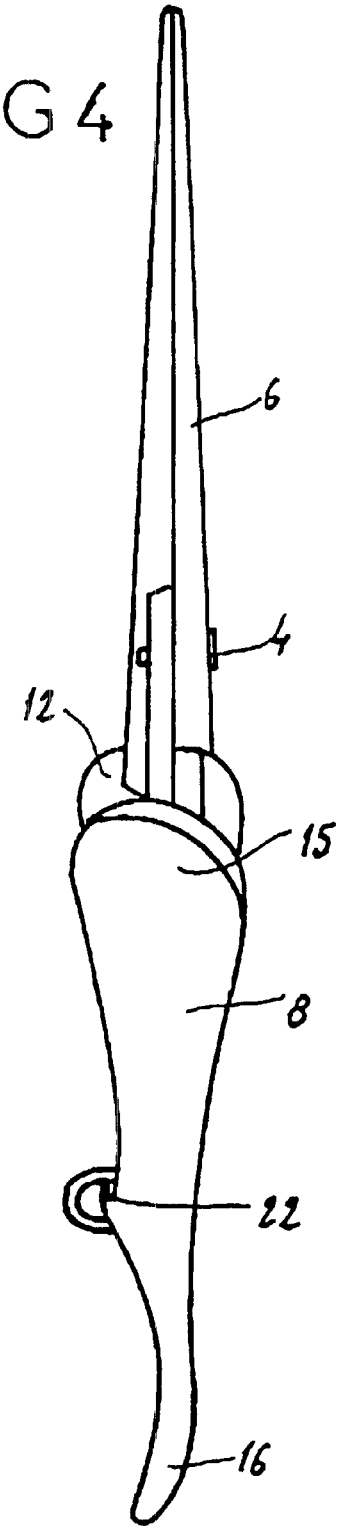
FIG. 4 is a view from the opposite side.

Scissors 1 also include a hook 21 mounted on rest embossment 7 and a notch 22 provided on rest embossment 8 to house hook 21. This engagement allows the maintenance of branches 2 and 3 in a closed position when not in use. As shown in FIGS. 3 and 4, this hook 21 is round-shaped to be disengaged from notch 22 with the thumb of the hand holding the scissors 1 and then to be secured on rest embossment in order to keep the scissors in an open position.

The invention provides ergonomic scissors, which remedy the inconveniences common to most prior-art scissors. In fact, the hook 10 allows a grasp of the scissors solely by the engagement of the third or fourth finger in the housing 11 and by the tightening of the base of hook 10 between the finger engaged in housing 11 and the adjacent finger. The hook 10 allows the pivoting of the scissors in an open position farther than the action of the springs 20. The thumb has therefore no role in the grasp of the scissors; it only comes to rest against the corresponding face 8*a* of rest embossment 8 to activate the branches and to also help the opening of the scissors farther than the action of springs 20.

The broad rest area of the four fingers, excluding the thumb, against rest embossment 7, the ledges shaped by the extremities 12 and 15, and the shape of portions 14 and 16 allow a perfect grasp and control of direction of the scissors when cutting.

These scissors can also be used in a similar way and with similar comfort by a left-handed or right-handed person.

What is claimed is:

1. Ergonomic scissors, comprising:

first and second branches each having a blade, the first branch having a first resting part for four fingers of a user, excluding a thumb of the user, the second branch having a second resting part for the thumb;

the first resting part having an exterior lateral face upon which the fingers are rested, the lateral face being joined to a hook distal to and curving away from the blade of the first branch, the hook having a concave face to accept the third or fourth finger of the user and a convex face against which the finger adjacent the finger accepted by the concave face may bear, whereby the hook is engaged by the fingers;

the second resting part having an exterior lateral face for accommodating the thumb, the exterior lateral face of the second resting part being widened in a plane perpendicular to a plane of the opening of the branches relative to each other; and at least one elastic device located between the two exterior lateral faces of the two resting parts for biasing the branches into a normally spread-apart position.

2. The scissors according to claim 1, wherein at least one of the resting parts includes a curved extremity laterally oriented relative to a longitudinal axis of the branches and on the exterior of the at least one of the resting part, the extremity having a concave face contiguous to the lateral face of the resting part of the branch.

3. The scissors according to claim 1, wherein the first resting part includes a curved extremity, the concave face thereof being spaced from the hook of the first resting part a distance corresponding approximately to the width of the finger or fingers placed between the hook and the curved extremity of the first resting part.

4. The scissors according to one of claim 1, 2 or 3, wherein the second resting part has a portion distal from the blade of the second branch with an inflexion towards an exterior of the second branch.

5. The scissors according to claim 1, 2 or 3, wherein the first resting part has a distal portion forming an inflexion towards the exterior of the branch.

6. The scissors according to claim 1, 2 or 3, wherein the elastic device comprises two helicoidal cone-shaped springs, each of which is attached to a respective one of the resting parts, and positioned to contact each other.

* * * * *